US010125708B2

(12) United States Patent
Okabe et al.

(10) Patent No.: US 10,125,708 B2
(45) Date of Patent: Nov. 13, 2018

(54) INTERNAL COMBUSTION ENGINE

(71) Applicant: TOYOTA JIDOSHA KABUSHIKI KAISHA, Toyota-shi, Aichi-ken (JP)

(72) Inventors: Yukihiro Okabe, Seto (JP); Tatsuya Tahara, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 42 days.

(21) Appl. No.: 15/227,121

(22) Filed: Aug. 3, 2016

(65) Prior Publication Data

US 2017/0037802 A1 Feb. 9, 2017

(30) Foreign Application Priority Data

Aug. 5, 2015 (JP) ..... 2015-155162

(51) Int. Cl.
*F02D 41/30* (2006.01)
*F02D 41/02* (2006.01)
(Continued)

(52) U.S. Cl.
CPC ..... *F02D 41/0295* (2013.01); *F01N 3/0864* (2013.01); *F01N 9/00* (2013.01);
(Continued)

(58) Field of Classification Search
CPC ..... F01N 13/008; F01N 3/0864; F01N 9/00; F02D 41/0295; F02D 41/126;
(Continued)

(56) References Cited

U.S. PATENT DOCUMENTS 5,713,199 A * 2/1998 Takeshima ..... B01D 53/9495 60/276
5,953,907 A * 9/1999 Kato ..... B01D 53/9431 60/274
(Continued)

FOREIGN PATENT DOCUMENTS

EP 2952714 A1 12/2015
JP 2000-008920 A 1/2000
(Continued)

*Primary Examiner* — Phutthiwat Wongwian
*Assistant Examiner* — Matthew T Largi
(74) *Attorney, Agent, or Firm* — Hunton Andrews Kurth LLP

(57) ABSTRACT

An air-fuel ratio control device switches a target air-fuel ratio from a lean set air-fuel ratio to a rich set air-fuel ratio after judging that an air-fuel ratio of an outflowing exhaust gas has become a stoichiometric air-fuel ratio and an oxygen storage amount of an exhaust purification catalyst has become a switching reference storage amount, and makes an average value of the target air-fuel ratio the stoichiometric air-fuel ratio to less than the lean set air-fuel ratio, from after the estimated value of the oxygen storage amount has become the switching reference storage amount or more until judging that the air-fuel ratio of the outflowing exhaust gas has become the stoichiometric air-fuel ratio if the estimated value of the oxygen storage amount becomes the switching reference storage amount or more before judging that the air-fuel ratio of the outflowing exhaust gas has become the stoichiometric air-fuel ratio.

4 Claims, 7 Drawing Sheets

(51) Int. Cl.

| | |
|---|---|
| ***F02D 41/12*** | (2006.01) |
| ***F02D 41/14*** | (2006.01) |
| ***F01N 9/00*** | (2006.01) |
| ***F01N 13/00*** | (2010.01) |
| *F01N 3/08* | (2006.01) |

(52) U.S. Cl.
CPC ..... *F01N 13/008* (2013.01); *F02D 41/126* (2013.01); *F02D 41/1441* (2013.01); *F02D 41/1453* (2013.01); *F02D 41/1455* (2013.01); *F02D 41/1456* (2013.01); *F02D 41/1475* (2013.01); *F02D 41/3005* (2013.01); *F01N 3/0814* (2013.01); *F01N 2570/16* (2013.01); *F02D 2041/147* (2013.01)

(58) Field of Classification Search
CPC ..... F02D 41/1441; F02D 41/1453; F02D 41/1455; F02D 41/1456; F02D 41/1475
See application file for complete search history.

(56) References Cited

U.S. PATENT DOCUMENTS

| | | | | |
|---|---|---|---|---|
| 5,970,707 | A * | 10/1999 | Sawada | B01D 53/9454 123/691 |
| 6,220,017 | B1 | 4/2001 | Tayama et al. | |
| 2003/0172645 | A1* | 9/2003 | Schnaibel | F01N 3/0842 60/285 |
| 2009/0320454 | A1* | 12/2009 | Sawada | F01N 3/0864 60/285 |
| 2015/0354487 | A1 | 12/2015 | Sasaki et al. | |
| 2016/0061084 | A1 | 3/2016 | Okazaki et al. | |

FOREIGN PATENT DOCUMENTS

| | | | | |
|---|---|---|---|---|
| JP | WO 2014118891 | A1 * | 8/2014 | G01N 27/41 |
| WO | 2014/118891 | A1 | 8/2014 | |
| WO | 2014/118892 | A1 | 8/2014 | |

* cited by examiner

INTERNAL COMBUSTION ENGINE

CROSS-REFERENCE TO RELATED APPLICATION

The present application claims priority to Japanese Patent Application No. 2015-155162 filed on Aug. 5, 2015, which is incorporated herein by reference in its entirety.

TECHNICAL FIELD

Embodiments of the present invention relate to an internal combustion engine.

BACKGROUND ART

Known in the past has been an internal combustion engine in which an exhaust passage is provided with an air-fuel ratio sensor, and an output of this air-fuel ratio sensor is used as the basis for feedback control of the amount of fuel fed to a combustion chamber of the internal combustion engine so that the air-fuel ratio of the exhaust gas flowing into the exhaust purification catalyst becomes a target air-fuel ratio (for example, stoichiometric air-fuel ratio (14.6)).

In the internal combustion engine described in International Patent Publication No. 2014/118892A, an upstream side air-fuel ratio sensor is arranged at an upstream side of the exhaust purification catalyst in the exhaust flow direction, while a downstream side air-fuel ratio sensor is arranged at a downstream side of the exhaust purification catalyst in the exhaust flow direction. In this internal combustion engine, a target air-fuel ratio of the exhaust gas flowing into the exhaust purification catalyst is switched between a rich set air-fuel ratio richer than the stoichiometric air-fuel ratio and a lean set air-fuel ratio leaner than the stoichiometric air-fuel ratio. For example, the target air-fuel ratio is switched from the rich set air-fuel ratio to the lean set air-fuel ratio when the air-fuel ratio detected by the downstream side air-fuel ratio sensor has become a rich judged air-fuel ratio richer than the stoichiometric air-fuel ratio or has become less. Further, the target air-fuel ratio is switched from the lean set air-fuel ratio to the rich set air-fuel ratio when the air-fuel ratio detected by the downstream side air-fuel ratio sensor becomes higher than the rich judged air-fuel ratio and an estimated value of an oxygen storage amount of the exhaust purification catalyst becomes a predetermined switching reference storage amount or more.

CITATIONS LIST

Patent Literature

PLT 1. International Patent Publication No. 2014/118892A
PLT 2. Japanese Patent Publication No. 2000-8920A

SUMMARY

Technical Problem

In this regard, the richer the air-fuel ratio of the air-fuel mixture fed to a combustion chamber, the greater the carbon monoxide in the exhaust gas. If exhaust gas containing carbon monoxide reaches the exhaust purification catalyst, the moisture in the exhaust gas and the carbon monoxide react in the exhaust purification catalyst whereby hydrogen and carbon dioxide are produced. Therefore, the richer the air-fuel ratio of the air-fuel mixture fed to a combustion chamber, the higher the concentration of hydrogen in the exhaust gas flowing out from the exhaust purification catalyst.

Further, hydrogen has a fast speed of passing through a diffusion regulating layer of an air-fuel ratio sensor. For this reason, if the concentration of hydrogen in the exhaust gas is high, the output air-fuel ratio of the downstream side air-fuel ratio sensor ends up deviating to a side lower than the actual air-fuel ratio of the exhaust gas (that is, the rich side). If the target air-fuel ratio is switched from the rich set air-fuel ratio to the lean set air-fuel ratio in the state where the concentration of hydrogen in the exhaust gas is high, even after the target air-fuel ratio is switched, the state of a high concentration of hydrogen in the exhaust gas will be maintained for a predetermined time period. For this reason, a time period from after the target air-fuel ratio is switched from the rich set air-fuel ratio to the lean set air-fuel ratio until the output air-fuel ratio of the downstream side air-fuel ratio sensor becomes higher than the rich judged air-fuel ratio becomes longer. As a result, while the target air-fuel ratio is set to the lean set air-fuel ratio, the amount of oxygen stored in the exhaust purification catalyst is liable to increase and the exhaust emission is liable to deteriorate.

Therefore, in consideration of the above problem, an object of embodiments of the present invention is to provide an internal combustion engine able to suppress deterioration of the exhaust emission due to the output air-fuel ratio of the downstream side air-fuel ratio sensor deviating to the rich side.

Embodiments of the present invention solve the above problem, and a summary is as follows.

(1) An internal combustion engine comprising an exhaust purification catalyst arranged in an exhaust passage and able to store oxygen, a downstream side air-fuel ratio sensor arranged at a downstream side of the exhaust purification catalyst in a direction of exhaust flow and detecting an air-fuel ratio of an outflowing exhaust gas flowing out from the exhaust purification catalyst, and an air-fuel ratio control device setting a target air-fuel ratio of an inflowing exhaust gas flowing into the exhaust purification catalyst and controlling an amount of fuel fed to a combustion chamber so that an air-fuel ratio of the inflowing exhaust gas matches the target air-fuel ratio. The air-fuel ratio control device switches the target air-fuel ratio to a lean set air-fuel ratio if, after setting the target air-fuel ratio to a rich set air-fuel ratio, the air-fuel ratio detected by the downstream side air-fuel ratio sensor reaches a rich judged air-fuel ratio, and switches the target air-fuel ratio to the rich set air-fuel ratio if, after setting the target air-fuel ratio to the lean set air-fuel ratio, judging that the air-fuel ratio of the outflowing exhaust gas has become a stoichiometric air-fuel ratio and an estimated value of an oxygen storage amount of the exhaust purification catalyst becomes a switching reference storage amount smaller than a maximum storable oxygen amount or becomes larger, and the rich set air-fuel ratio is an air-fuel ratio richer than the stoichiometric air-fuel ratio, the rich judged air-fuel ratio is an air-fuel ratio richer than the stoichiometric air-fuel ratio and leaner than the rich set air-fuel ratio, and the lean set air-fuel ratio is an air-fuel ratio leaner than the stoichiometric air-fuel ratio. The air-fuel ratio control device controls the target air-fuel ratio so that an average value of the target air-fuel ratio, from after the estimated value of the oxygen storage amount has become the switching reference storage amount or more until judging that the air-fuel ratio of the outflowing exhaust gas has become the stoichiometric air-fuel ratio, becomes the stoichiometric air-fuel ratio to less than the lean set air-fuel ratio if, after setting the target air-fuel ratio to the lean set air-fuel ratio and before judging that the air-fuel ratio of the outflowing exhaust gas has become the stoichiometric air-fuel ratio, the estimated value of the oxygen storage amount becomes the switching reference storage amount or more.

(2) An internal combustion engine described in above (1), wherein the air-fuel ratio control device sets the target air-fuel ratio to the stoichiometric air-fuel ratio from after the estimated value of the oxygen storage amount has become the switching reference storage amount or more until judging that the air-fuel ratio of the outflowing exhaust gas has become the stoichiometric air-fuel ratio if, after setting the target air-fuel ratio to the lean set air-fuel ratio and before judging that the air-fuel ratio of the outflowing exhaust gas has become the stoichiometric air-fuel ratio, the estimated value of the oxygen storage amount becomes the switching reference storage amount or more.

(3) An internal combustion engine described in above (1) or (2), wherein the engine further comprises an upstream side air-fuel ratio sensor arranged at an upstream side of the exhaust purification catalyst in the direction of exhaust flow and detecting the air-fuel ratio of the inflowing exhaust gas, the air-fuel ratio control device controls by feedback the amount of fuel fed to the combustion chamber so that an air-fuel ratio detected by the upstream side air-fuel ratio sensor matches the target air-fuel ratio, and the estimated value of the oxygen storage amount is calculated based on the air-fuel ratio detected by the upstream side air-fuel ratio sensor.

According to embodiments of the present invention, there is provided an internal combustion engine able to suppress deterioration of the exhaust emission due to the output air-fuel ratio of the downstream side air-fuel ratio sensor deviating to the rich side.

DETAILED DESCRIPTION OF EMBODIMENTS

Figure 1:
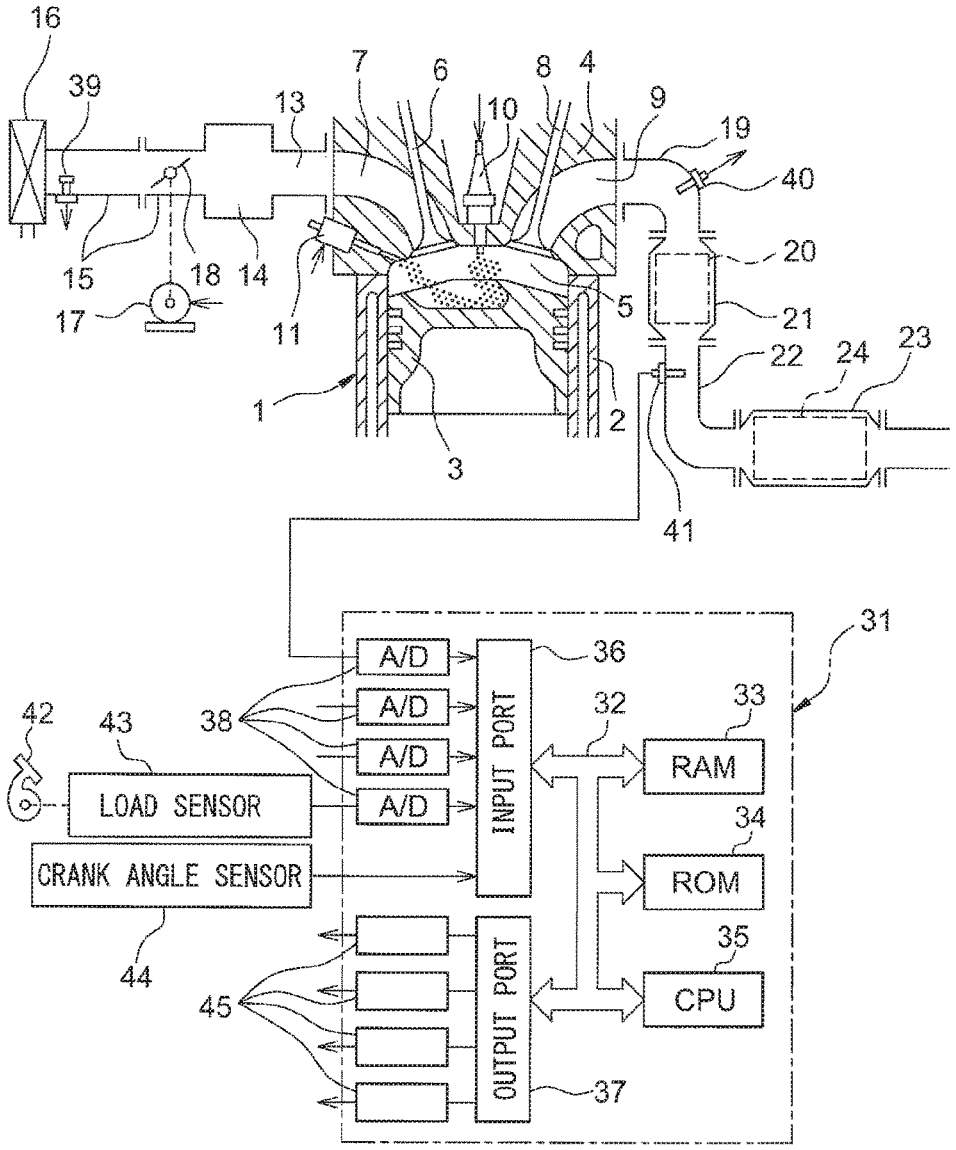
FIG. 1 is a view schematically showing an internal combustion engine in an embodiment of the present invention.

Referring to the drawings, an embodiment of the present invention will be explained in detail below. Note that, in the following explanation, similar component elements are assigned the same reference numerals.

<Explanation of Internal Combustion Engine as a Whole>

FIG. 1 is a view which schematically shows an internal combustion engine in an embodiment of the present invention. The internal combustion engine in the present embodiment is mounted on, for example, a vehicle. Referring to FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, at the center part of the inside wall surface of the cylinder head 4, a spark plug 10 is arranged. A fuel injector 11 is arranged around the inside wail surface of the cylinder head 4. The spark plug 10 is configured to cause generation of a spark in accordance with an ignition signal. Further, the fuel injector 11 injects a predetermined amount of fuel into the combustion chamber 5 in accordance with an injection signal. Note that, the fuel injector 11 may be arranged so as to inject fuel inside the intake port 7. Further, in the present embodiment, as the fuel, gasoline with a stoichiometric air-fuel ratio of 14.6 is used.

The intake port 7 in each cylinder is connected through a corresponding intake runner 13 to a surge tank 14. The surge tank 14 is connected through an intake pipe 15 to an air cleaner 16. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be turned by the throttle valve drive actuator 17 to thereby change the opening area of the intake passage.

On the other hand, the exhaust port 9 in each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which has an upstream side exhaust purification catalyst 20 built into it. The upstream side casing 21 is connected through an exhaust pipe 22 to a downstream side casing 23 which has a downstream side exhaust purification catalyst 24 built into it. The exhaust port 9, exhaust manifold 19, upstream side casing 21, exhaust pipe 22, and downstream side casing 23 form an exhaust passage.

An electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, i.e., at the upstream side of the upstream side exhaust purification catalyst 20 in a direction of exhaust flow, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, i.e., at the downstream side of the upstream side exhaust purification catalyst 20 in a direction of exhaust flow, a downstream side air-fuel ratio sensor 41 is arranged which detects the air-fuel ratio of the exhaust gas flowing through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. A crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that, ECU 31 acts as a control system for controlling the internal combustion engine.

Note that, although the internal combustion engine according to the present embodiment is a non-supercharged internal combustion engine using gasoline as a fuel, the construction of the internal combustion engine according to the present invention is not limited to the above construction. For example, an arrangement of cylinders, a method of injecting a fuel, constructions of intake and exhaust system, constructions of valve gears, presence or absence of a supercharger, and a construction of a supercharge in the internal combustion engine according to embodiments of the present invention may be different from the above internal combustion engine.

<Explanation of Exhaust Purification Catalyst>

The upstream side exhaust purification catalyst 20 and the downstream side exhaust purification catalyst 24 are three-way catalysts which have an oxygen storage ability. Specifically, the exhaust purification catalysts 20 and 24 are three-way catalysts which comprise a carrier made of ceramic on which a precious metal (for example, platinum Pt) having a catalyst effect and a substance having an oxygen storage ability (for example, ceria $CeO_2$) are carried. A three-way catalyst has the function of simultaneously purifying unburned HC, CO, etc., (below, referred to as "unburned gas") and $NO_x$ when the air-fuel ratio of the exhaust gas flowing into the three-way catalyst is maintained at the stoichiometric air-fuel ratio. In addition, when the exhaust purification catalysts 20 and 24 store a certain extent of oxygen, the unburned gas and $NO_x$ are simultaneously purified even if the air-fuel ratio of the exhaust gas flowing into the exhaust purification catalysts 20 and 24 somewhat deviates from the stoichiometric air-fuel ratio to the rich side or lean side.

Accordingly, if the exhaust purification catalysts 20 and 24 can store oxygen, that is, if the oxygen storage amount of the exhaust purification catalysts 20 and 24 is less than the maximum storage oxygen amount, if the air-fuel ratio of the exhaust gas flowing into the exhaust purification catalysts 20, 24 becomes somewhat leaner than the stoichiometric air-fuel ratio, the excess oxygen contained in the exhaust gas is stored in the exhaust purification catalysts 20, 24. Therefore, the surfaces of the exhaust purification catalysts 20 and 24 are maintained at the stoichiometric air-fuel ratio. As a result, on the surfaces of the exhaust purification catalysts 20 and 24, the unburned gas and $NO_x$ are simultaneously purified. At this time, the air-fuel ratio of the exhaust gas flowing out from the exhaust purification catalysts 20 and 24 becomes the stoichiometric air-fuel ratio.

On the other hand, if exhaust purification catalysts 20 and 24 can release oxygen, that is, the oxygen storage amount of the exhaust purification catalysts 20 and 24 is more than zero, if the air-fuel ratio of the exhaust gas flowing into the exhaust purification catalysts 20, 24 becomes somewhat richer than the stoichiometric air-fuel ratio, the oxygen which is insufficient for oxidizing the unburned gas contained in the exhaust gas, is released from the exhaust purification catalysts 20 and 24. Therefore, the surfaces of the exhaust purification catalysts 20 and 24 are maintained at the stoichiometric air-fuel ratio. As a result, on the surfaces of the exhaust purification catalysts 20 and 24, the unburned gas and $NO_x$ are simultaneously purified. At this time, the air-fuel ratio of the exhaust gas flowing out from the exhaust purification catalysts 20 and 24 becomes the stoichiometric air-fuel ratio.

In this way, if the exhaust purification catalysts 20, 24 store a certain extent of oxygen, even if the air-fuel ratio of the exhaust gas flowing into the exhaust purification catalysts 20, 24 deviates slightly from the stoichiometric air-fuel ratio to the rich side or lean side, the unburned gas and $NO_x$ are simultaneously removed and the air-fuel ratio of the exhaust gas flowing out from the exhaust purification catalysts 20, 24 becomes the stoichiometric air-fuel ratio. If the excess oxygen can no longer be stored in the exhaust purification catalysts 20, 24 or the deficient oxygen can no longer be released from the oxygen exhaust purification catalysts 20, 24, the air-fuel ratio of the exhaust gas from the exhaust purification catalysts 20, 24 becomes lean or rich, and $NO_x$ or HC and CO flow out from the exhaust purification catalysts 20, 24. This will be explained referring to FIGS. 2A and 2B.

Figure 2A:
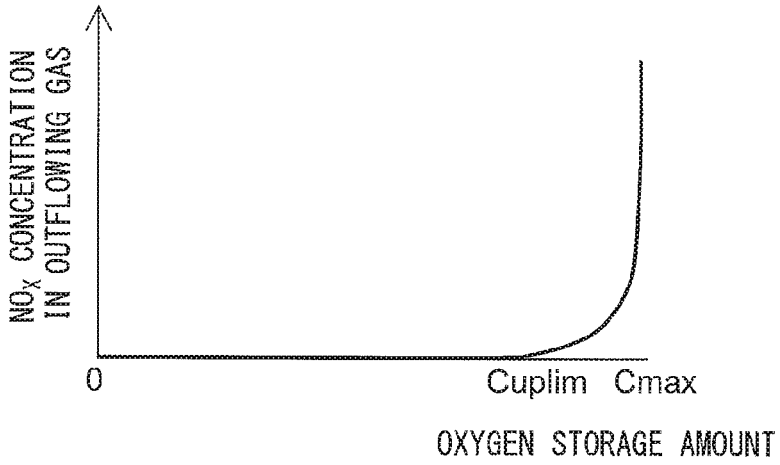
FIG. 2A and FIG. 2B are views showing a relationship between an oxygen storage amount of an exhaust purification catalyst and a concentration of $NO_x$ or a concentration of HC and CO in exhaust gas flowing out from an exhaust purification catalyst.
Figure 2B:
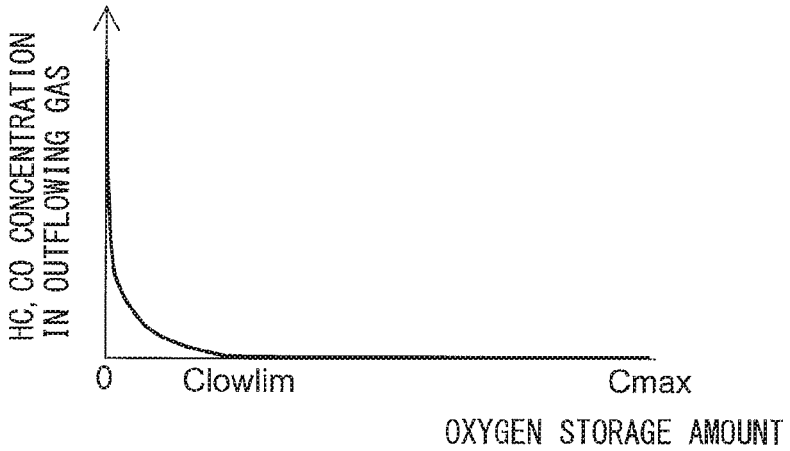

FIG. 2A shows the relationship between an oxygen storage amount of the exhaust purification catalyst and a concentration of $NO_x$ in the exhaust gas flowing out from the exhaust purification catalyst, while FIG. 2B shows the relationship between an oxygen storage amount of the exhaust purification catalyst and a concentration of HC and CO in the exhaust gas flowing out from the exhaust purification catalyst. When the air-fuel ratio of the exhaust gas flowing into the exhaust purification catalysts 20, 24 is lean, if the oxygen storage amount of the exhaust purification catalysts 20, 24 becomes greater, the excess oxygen contained in the exhaust gas can no longer be stored in the exhaust purification catalysts 20, 24 and as a result the surfaces of the exhaust purification catalysts 20, 24 become states of excess oxygen. If becoming states of excess oxygen, the HC and CO are oxidized, but the $NO_x$ is no longer reduced. Therefore, as shown in FIG. 2A, if the oxygen storage amount exceeds a certain stored amount near the maximum storable oxygen amount Cmax (Cuplim in the figure), the concentration of $NO_x$ in the exhaust gas flowing out from the exhaust purification catalysts 20, 24 rapidly rises.

On the other hand, if the air-fuel ratio of the exhaust gas flowing into the exhaust purification catalysts 20, 24 is rich, if the oxygen storage amount of the exhaust purification catalysts 20, 24 becomes smaller, the oxygen stored in the exhaust purification catalysts 20, 24 can no longer be sufficiently released. As a result, the surfaces of the exhaust purification catalysts 20, 24 become states of excess HC and CO. If in this way the surfaces become states of excess HC and CO, the $NO_x$ is reduced, but HC and CO are no longer oxidized. Therefore, as shown in FIG. 2B, if the oxygen storage amount becomes smaller than a certain stored amount near zero (Clowlim in the figure), the concentration of HC and CO in the exhaust gas flowing out from the exhaust purification catalysts 20, 24 rapidly rises.

That is, if the oxygen storage amount is maintained between the Clowlim of FIG. 2B and the Cuplim of FIG. 2A, even if the air-fuel ratio of the exhaust gas flowing into the exhaust purification catalysts 20, 24 deviates somewhat from the stoichiometric air-fuel ratio to the rich side or lean side, unburned HC, CO, and $NO_x$ are simultaneously removed.

<Output Characteristics of Air-Fuel Ratio Sensors>

Figure 3:
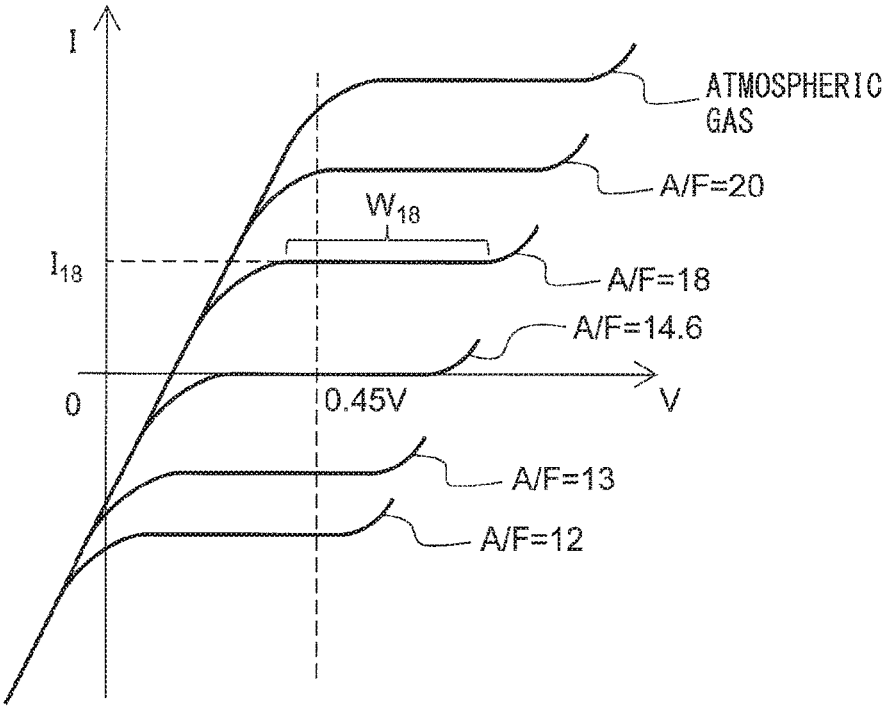
FIG. 3 is a view showing a relationship of a sensor applied voltage and an output current at different exhaust air-fuel ratios.
Figure 4:
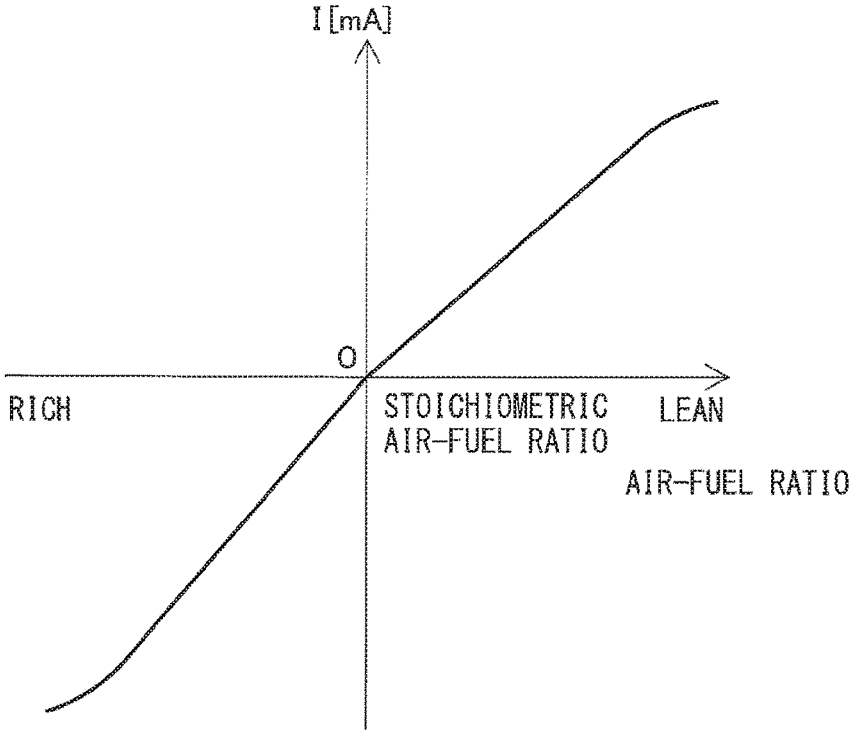
FIG. 4 is a view showing a relationship between an exhaust air-fuel ratio and an output current if a sensor applied voltage is constant.

Next, referring to FIG. 3 and FIG. 4, the output characteristics of the air-fuel ratio sensors 40, 41 in the present embodiment will be explained. FIG. 3 is a view showing the voltage-current (V-I) characteristics of the air-fuel ratio sensors 40, 41 in the present embodiment, while FIG. 4 is a view showing the relationship between the air-fuel ratio of the exhaust gas circulating around the air-fuel ratio sensors 40, 41 (below, referred to as the "exhaust air-fuel ratio") and the output current I when maintaining the applied voltage constant. Note that, in the present embodiment, as the air-fuel ratio sensors 40, 41, the same configurations of air-fuel ratio sensors are used.

As will be understood from FIG. 3, in the air-fuel ratio sensors 40, 41 of the present embodiment, the output current I becomes larger the higher the exhaust air-fuel ratio (the leaner). Further, in the V-I line of each exhaust air-fuel ratio, there is a region substantially parallel to the V-axis, that is, a region where the output current does not change much at all even if the applied voltage changes. This voltage region is called a "limit current region". The current is called a "limit current". In FIG. 3, the limit current region and the limit current if the exhaust air-fuel ratio is 18 are respectively shown by $W_{18}$ and $I_{18}$. Therefore, the air-fuel ratio sensors 40, 41 can be said to be limit current type air-fuel ratio sensors.

FIG. 4 is a view showing the relationship between the exhaust air-fuel ratio and the output current I if the applied voltage is around 0.45V. As will be understood from FIG. 4, in the air-fuel ratio sensors 40, 41, the higher the exhaust air-fuel ratio (that is, the leaner), the greater the output current I of the air-fuel ratio sensors 40, 41 becomes. In addition, the air-fuel ratio sensors 40, 41 are configured so that the output current I becomes zero if the exhaust air-fuel ratio is the stoichiometric air-fuel ratio. Accordingly, the air-fuel ratio sensors 40, 41 can continuously (linearly) detect the exhaust air-fuel ratio. Further, if the exhaust air-fuel ratio becomes larger by a certain extent or more or when it becomes smaller by a certain extent or less, the ratio of the change of the output current with respect to the change of the exhaust air-fuel ratio becomes smaller.

Note that, in the above example, as the air-fuel ratio sensors 40, 41, limit current type air-fuel ratio sensors are used. However, so long as the output current linearly changes with respect to the exhaust air-fuel ratio, as the air-fuel ratio sensors 40, 41, it is also possible to use any other air-fuel ratio sensors such as air-fuel ratio sensors that are not the limit current type. Further, the air-fuel ratio sensors 40, 41 may also be air-fuel ratio sensors of structures different from each other.

<Basic Air-Fuel Ratio Control>

Next, the basic air-fuel ratio control in an internal combustion engine of the present embodiment will be explained. The internal combustion engine of the present embodiment is provided with an air-fuel ratio control device controlling the air-fuel ratio of the exhaust gas flowing into the upstream side exhaust purification catalyst 20 (below, simply referred to as "inflowing exhaust gas"). Note that, in the present embodiment, the ECU 31 functions as an air-fuel ratio control device.

The air-fuel ratio control device sets the target air-fuel ratio of the inflowing exhaust gas and controls the amount of fuel fed to the combustion chamber 5 so that the air-fuel ratio of the inflowing exhaust gas matches the target air-fuel ratio. Specifically, the air-fuel ratio control device controls the amount of fuel fed to the combustion chamber 5 by feedback so that the output air-fuel ratio of the upstream side air-fuel ratio sensor 40 matches the target air-fuel ratio. Note that, the amount of fuel fed to a combustion chamber 5 may also be controlled without using the upstream side air-fuel ratio sensor 40. Here, the amount of fuel calculated from the amount of intake air detected by the air flowmeter 39 and the target air-fuel ratio is fed to a combustion chamber 5 so that the ratio of the fuel and air fed to the combustion chamber 5 matches the target air-fuel ratio. Note that, the "output air-fuel ratio" means an air-fuel ratio corresponding to an output value of the air-fuel ratio sensor.

The air-fuel ratio control device alternately switches the target air-fuel ratio of the inflowing exhaust gas between a rich set air-fuel ratio richer than the stoichiometric air-fuel ratio and a lean set air-fuel ratio leaner than the stoichiometric air-fuel ratio. The rich set air-fuel ratio is a predetermined air-fuel ratio richer than the stoichiometric air-fuel ratio (air-fuel ratio becoming control center) by a certain extent and for example is made 14 to 14.55 or so. Further, the rich set air-fuel ratio can also be expressed as an air-fuel ratio of the air-fuel ratio becoming the control center (in the present embodiment, the stoichiometric air-fuel ratio) reduced by a rich correction amount. On the other hand, the lean set air-fuel ratio is a predetermined air-fuel ratio leaner by a certain extent from the stoichiometric air-fuel ratio, for example, is made 14.65 to 16 or so. Further, the lean set air-fuel ratio can also be expressed as an air-fuel ratio of the air-fuel ratio becoming the control center increased by a lean correction amount. Note that, in the present embodiment, the difference of the rich set air-fuel ratio from the stoichiometric air-fuel ratio (rich degree) is made the difference of the lean set air-fuel ratio from the stoichiometric air-fuel ratio (lean degree) or less.

More specifically, the air-fuel ratio control device switches the target air-fuel ratio from the rich set air-fuel ratio to the lean set air-fuel ratio if, after setting the target air-fuel ratio to the rich set air-fuel ratio, the output air-fuel ratio of the downstream side air-fuel ratio sensor 41 reaches a predetermined rich judged air-fuel ratio. The rich judged air-fuel ratio is an air-fuel ratio richer than the stoichiometric air-fuel ratio and leaner than the rich set air-fuel ratio, for example, is made 14.55. The air-fuel ratio control device judges that the air-fuel ratio of the exhaust gas flowing out from the upstream side exhaust purification catalyst 20 (below, simply referred to as the "outflowing exhaust gas") has become richer than the stoichiometric air-fuel ratio if, after the target air-fuel ratio is set to the rich set air-fuel ratio, the output air-fuel ratio of the downstream side air-fuel ratio sensor 41 has reached the rich judged air-fuel ratio.

Further, the air-fuel ratio control device switches the target air-fuel ratio from the lean set air-fuel ratio to the rich set air-fuel ratio if, after setting the target air-fuel ratio to the lean set air-fuel ratio, judging that the air-fuel ratio of the outflowing exhaust gas has become the stoichiometric air-fuel ratio and an estimated value of the oxygen storage amount of the upstream side exhaust purification catalyst 20 becomes a switching reference storage amount smaller than the maximum storable oxygen amount or becomes more.

For example, the air-fuel ratio control device judges that the air-fuel ratio of the outflowing exhaust gas has become the stoichiometric air-fuel ratio if, after setting the target air-fuel ratio to the lean set air-fuel ratio, the output air-fuel ratio of the downstream side air-fuel ratio sensor 41 becomes higher than the rich judged air-fuel ratio. Further, the air-fuel ratio control device may judge that the air-fuel ratio of the outflowing exhaust gas has become the stoichiometric air-fuel ratio if, after setting the target air-fuel ratio to the lean set air-fuel ratio, the output air-fuel ratio of the downstream side air-fuel ratio sensor 41 reaches the stoichiometric air-fuel ratio (14.6).

Further, the estimated value of the oxygen storage amount of the upstream side exhaust purification catalyst 20 is calculated by cumulatively adding the oxygen excess/deficiency from the stoichiometric air-fuel ratio of the inflowing exhaust gas. The "oxygen excess/deficiency from the stoichiometric air-fuel ratio of the inflowing exhaust gas" means an amount of oxygen which becomes in excess or an amount of oxygen which becomes deficient when trying to make the air-fuel ratio of the inflowing exhaust gas the stoichiometric air-fuel ratio. In lean control where the target air-fuel ratio is set to the lean set air-fuel ratio, the oxygen in the inflowing exhaust gas becomes excessive. This excess oxygen is stored in the upstream side exhaust purification catalyst 20. Therefore, the cumulative value of the oxygen excess/deficiency in lean control (below, referred to as the "cumulative oxygen excess/deficiency") corresponds to the oxygen storage amount stored in the upstream side exhaust purification catalyst 20 during lean control.

The oxygen excess/deficiency OED is for example calculated by the following formula (1) based on the output of the upstream side air-fuel ratio sensor 40:

$$OED=0.23\times(AFup-AFR)\times Qi \quad (1)$$

where, 0.23 indicates a concentration of oxygen in the air, Qi indicates a fuel injection amount, AFup indicates an output air-fuel ratio of the upstream side air-fuel ratio sensor 40, and AFR indicates an air-fuel ratio serving as the control center (in the present embodiment, stoichiometric air-fuel ratio (14.6)).

Note that, the oxygen excess/deficiency OED may be calculated based on the target air-fuel ratio of the inflowing exhaust gas TAF without using the output of the upstream side air-fuel ratio sensor 40. Here, the oxygen excess/deficiency OED is calculated by the following formula (2).

$$OED=0.23\times(TAF-AFR)\times Qi \quad (2)$$

<Explanation of Air-Fuel Ratio Control using Time Chart>

Figure 5:
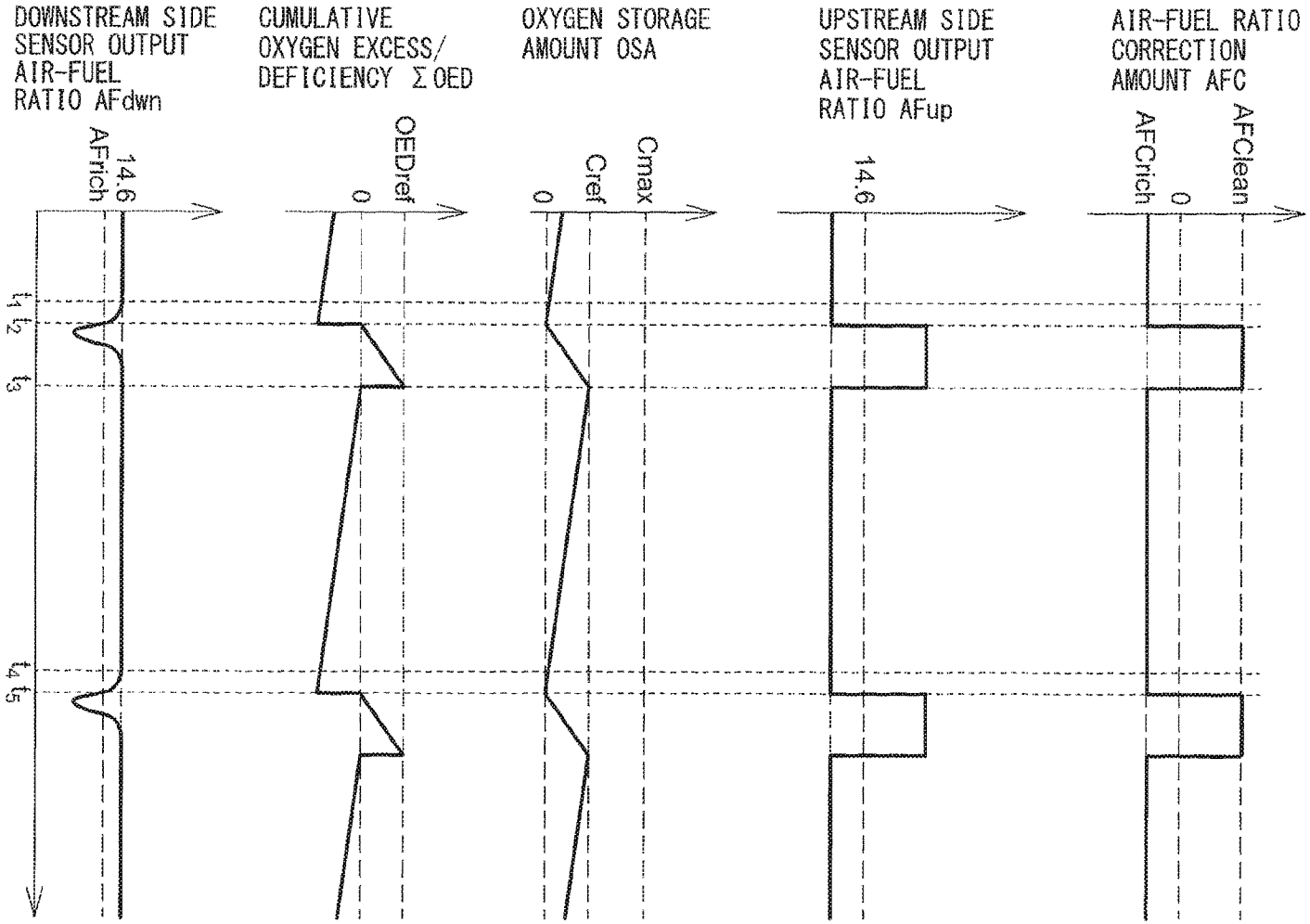
FIG. 5 is a time chart of an air-fuel ratio correction amount during basic air-fuel ratio control.

Referring to FIG. 5, the above-mentioned operation will be explained in detail. FIG. 5 is a time chart of an air-fuel ratio correction amount AFC, output air-fuel ratio AFup of the upstream side air-fuel ratio sensor 40, oxygen storage amount OSA of the upstream side exhaust purification catalyst 20, cumulative oxygen excess/deficiency ΣOED, and output air-fuel ratio AFdwn of the downstream side air-fuel ratio sensor 41 during the basic air-fuel ratio control.

The cumulative oxygen excess/deficiency ΣOED which is shown in FIG. 5 shows the cumulative value of the oxygen excess/deficiency OED which is calculated by the above formula (1). The cumulative oxygen excess/deficiency ΣOED is reset and made zero if the target air-fuel ratio is switched between the rich set air-fuel ratio and the lean set air-fuel ratio.

Note that the air-fuel ratio correction amount AFC is a correction amount relating to the target air-fuel ratio of the inflowing exhaust gas. If the air-fuel ratio correction amount AFC is 0, the target air-fuel ratio is set to an air-fuel ratio which is equal to the air-fuel ratio serving as the control center (below, referred to as the "control center air-fuel ratio") (in the present embodiment, the stoichiometric air-fuel ratio). If the air-fuel ratio correction amount AFC is a positive value, the target air-fuel ratio becomes an air-fuel ratio leaner than the control center air-fuel ratio (in the present embodiment, a lean air-fuel ratio). If the air-fuel ratio correction amount AFC is a negative value, the target air-fuel ratio becomes an air-fuel ratio richer than the control center air-fuel ratio (in the present embodiment, a rich air-fuel ratio). Further, the "control center air-fuel ratio" means the air-fuel ratio to which of the air-fuel ratio correction amount AFC is added in accordance with the engine operating state, that is, the air-fuel ratio which is the reference when changing the target air-fuel ratio in accordance with the air-fuel ratio correction amount AFC.

In the illustrated example, in the state before a time $t_1$, the air-fuel ratio correction amount AFC is made a rich set correction amount AFCrich (corresponding to the rich set air-fuel ratio). That is, the target air-fuel ratio is made the rich air-fuel ratio. Along with this, the output air-fuel ratio of the upstream side air-fuel ratio sensor 40 becomes a rich air-fuel ratio. The unburned gas contained in the inflowing exhaust gas is purified in the upstream side exhaust purification catalyst 20. Further, along with this, oxygen storage amount OSA of the upstream side exhaust purification catalyst 20 is gradually decreased. Accordingly, the cumulative oxygen excess/deficiency ΣOED is also gradually decreased. Further, the unburned gas is not contained in the outflowing exhaust gas due to the purification at the upstream side exhaust purification catalyst 20, so the output air-fuel ratio AFdwn of the downstream side air-fuel ratio sensor 41 becomes substantially the stoichiometric air-fuel ratio. Here, the air-fuel ratio of the inflowing exhaust gas which becomes the rich air-fuel ratio, so the amount of $NO_x$ which is exhausted from the upstream side exhaust purification catalyst 20 becomes substantially zero.

If the upstream side exhaust purification catalyst 20 gradually decreases in stored amount of oxygen OSA, the stored amount of oxygen OSA approaches zero at the time $t_1$. Along with this, part of the unburned gas which flows into the upstream side exhaust purification catalyst 20 starts to flow out without being purified by the upstream side exhaust purification catalyst 20. Due to this, from the time $t_1$ on, an output air-fuel ratio AFdwn of the downstream side air-fuel ratio sensor 41 gradually falls. As a result, at a time $t_2$, the output air-fuel ratio AFdwn of the downstream side air-fuel ratio sensor 41 reaches the rich judgment air-fuel ratio AFrich.

In the present embodiment, if the output air-fuel ratio AFdwn of the downstream side air-fuel ratio sensor 41 becomes the rich judgment air-fuel ratio AFrich or less, to make the stored amount of oxygen OSA increase, the air-fuel ratio correction amount AFC is switched to a lean set correction amount AFClean (corresponding to the lean set air-fuel ratio). Therefore, the target air-fuel ratio is switched from the rich air-fuel ratio to the can air-fuel ratio. Further, at this time, the cumulative oxygen excess/deficiency ΣOED is reset to 0.

Note that, in the present embodiment, the air-fuel ratio correction amount AFC is switched after the output air-fuel ratio AFdwn of the downstream side air-fuel ratio sensor 41 reaches the rich judgment air-fuel ratio AFrich. This is because even if the stored amount of oxygen of the upstream side exhaust purification catalyst 20 is sufficient, the air-fuel ratio of the outflowing exhaust gas sometimes ends up being slightly offset from the stoichiometric air-fuel ratio. Conversely speaking, the rich judgment air-fuel ratio AFrich is made an air-fuel ratio which the air-fuel ratio of the outflowing exhaust gas will never reach when the stored amount of oxygen of the upstream side exhaust purification catalyst 20 is sufficient.

At the time $t_2$, if the target air-fuel ratio is switched to the lean air-fuel ratio, the air-fuel ratio of the inflowing exhaust gas changes from the rich air-fuel ratio to the lean air-fuel ratio. Further, along with this, the output air-fuel ratio AFup of the upstream side air-fuel ratio sensor 40 becomes a lean air-fuel ratio (in actuality, a delay occurs from after the target air-fuel ratio is switched until the air-fuel ratio of the inflowing exhaust gas changes, but in the illustrated example, it is deemed for convenience that the change is simultaneous). If at the time $t_2$ the air-fuel ratio of the inflowing exhaust gas changes to the lean air-fuel ratio, the upstream side exhaust purification catalyst 20 increases in the stored amount of oxygen OSA. Further, along with this, the cumulative oxygen excess/deficiency ΣOED also gradually increases.

Due to this, the air-fuel ratio of the outflowing exhaust gas changes to the stoichiometric air-fuel ratio, and the output air-fuel ratio AFdwn of the downstream side air-fuel ratio sensor 41 converges to the stoichiometric air-fuel ratio. Here, the air-fuel ratio of the inflowing exhaust gas becomes the lean air-fuel ratio, but there is sufficient leeway in the oxygen storage ability of the upstream side exhaust purification catalyst 20, so the oxygen in the inflowing exhaust gas is stored in the upstream side exhaust purification catalyst 20 and the $NO_x$ is removed by reduction. For this reason, the exhaust of $NO_x$ from the upstream side exhaust purification catalyst 20 becomes substantially zero.

After this, if the upstream side exhaust purification catalyst 20 increases in stored amount of oxygen OSA, at a time $t_3$, the stored amount of oxygen OSA of the upstream side exhaust purification catalyst 20 reaches a switching reference storage amount Cref. For this reason, the cumulative oxygen excess/deficiency ΣOED reaches a switching reference value OEDref which corresponds to the switching reference storage amount Cref. In the present embodiment, if the cumulative oxygen excess/deficiency ΣOED becomes the switching reference value OEDref or more, the storage of oxygen in the upstream side exhaust purification catalyst 20 is suspended by switching the air-fuel ratio correction amount AFC to the rich set correction amount AFCrich. Therefore, the target air-fuel ratio is made the rich air-fuel ratio. Further, at this time, the cumulative oxygen excess/deficiency ΣOED is reset to 0.

Here, in the example which is shown in FIG. 5, at the time $t_3$, the target air-fuel ratio is switched and simultaneously the oxygen storage amount OSA falls, but in actuality, a delay occurs from after switching the target air-fuel ratio until the oxygen storage amount OSA falls. Further, if acceleration of the vehicle mounting the internal combustion engine causes the engine load to become higher and the intake air amount to greatly deviate for an instant, the air-fuel ratio of the inflowing exhaust gas sometimes unintentionally greatly deviates from the target air-fuel ratio for an instant.

As opposed to this, the switching reference storage amount Cref is set sufficiently lower than a maximum storable oxygen amount Cmax when the upstream side exhaust purification catalyst 20 is new. For this reason, even if the above mentioned delay occurs or the air-fuel ratio of the actual inflowing exhaust gas unintentionally greatly deviates from the target air-fuel ratio for an instant, the stored amount of oxygen OSA does not reach the maximum storable oxygen amount Cmax. Conversely, the switching reference storage amount Cref is made an amount sufficiently small so that the stored amount of oxygen OSA does not reach the maximum storable oxygen amount Cmax even if the above mentioned delay or unintentionally deviation of air-fuel ratio occurs. For example, the switching reference storage amount Cref is made ¾ or less of the maximum storable oxygen amount Cmax when the upstream side exhaust purification catalyst 20 is new, preferably ½ or less, more preferably ⅕ or less.

At the time $t_3$, if the target air-fuel ratio is switched to the rich air-fuel ratio, the air-fuel ratio of the inflowing exhaust gas changes from the lean air-fuel ratio to the rich air-fuel ratio. Along with this, the output air-fuel ratio AFup of the upstream side air-fuel ratio sensor 40 becomes a rich air-fuel ratio (in actuality, a delay occurs from after the target air-fuel ratio is switched until the inflowing exhaust gas changes in air-fuel ratio, but in the illustrated example, it is deemed for convenience that the change is simultaneous). The inflowing exhaust gas contains unburned gas, so the upstream side exhaust purification catalyst 20 gradually decreases in stored amount of oxygen OSA. At a time $t_4$, in the same way as the time $t_1$, the output air-fuel ratio AFdwn of the downstream side air-fuel ratio sensor 41 starts to fall. At this time as well, the air-fuel ratio of the inflowing exhaust gas is the rich air-fuel ratio, so $NO_x$ exhausted from the upstream side exhaust purification catalyst 20 becomes substantially zero.

Next, at a time $t_5$, in the same way as time $t_2$, the output air-fuel ratio AFdwn of the downstream side air-fuel ratio sensor 41 reaches the rich judgment air-fuel ratio AFrich. Due to this, the air-fuel ratio correction amount AFC is switched to the value AFClean which corresponds to the lean set air-fuel ratio. After this, the cycle of the above mentioned times $t_1$ to $t_5$ is repeated.

Further, in the present embodiment, while the above-mentioned cycle of the times $t_1$ to $t_5$ is repeated, the amount of fuel which is fed to the combustion chamber 5 is controlled by feedback so that the output air-fuel ratio AFup of the upstream side air-fuel ratio sensor 40 becomes the target air-fuel ratio. For example, if the output air-fuel ratio AFup of the upstream side air-fuel ratio sensor 40 is lower (richer) than the target air-fuel ratio, the amount of fuel which is fed to the combustion chamber 5 is made smaller. On the other hand, if the output air-fuel ratio AFup of the upstream side air-fuel ratio sensor 40 is higher (leaner) than the value corresponding to the target air-fuel ratio, the amount of fuel which is fed to the combustion chamber 5 becomes greater.

As will be understood from the above explanation, according to the present embodiment, it is possible to constantly suppress the amount of discharge of $NO_x$ from the upstream side exhaust purification catalyst 20. That is, so long as performing the above-mentioned control, basically, the amount of discharge of $NO_x$ from the upstream side exhaust purification catalyst 20 can be made substantially zero. Further, the cumulative time for calculating the cumulative oxygen excess/deficiency ΣOED is short, so there is less of a chance of calculation error compared with calculating the cumulative amount over a long period of time. For this reason, error in calculation of the cumulative oxygen excess/deficiency ΣOED can be kept from causing $NO_x$ to end up being discharged.

Further, in general, if the stored amount of oxygen of the exhaust purification catalyst is maintained constant, the exhaust purification catalyst falls in oxygen storage ability. That is, to maintain the exhaust purification catalyst high in oxygen storage ability, the stored amount of oxygen of the exhaust purification catalyst has to fluctuate. As opposed to this, according to the present embodiment, as shown in FIG. 5, the stored amount of oxygen OSA of the upstream side exhaust purification catalyst 20 constantly fluctuates up and down, so the oxygen storage ability is kept from falling.

<Fuel Cut Control>

Further, in the internal combustion engine of the present embodiment, at a time of deceleration of the vehicle mounting the internal combustion engine, fuel cut control is performed for stopping the injection of fuel from the fuel injector 11 to stop the feed of fuel into the combustion chamber 5 during operation of the internal combustion engine. This fuel cut control is started if a predetermined condition for start of fuel cut stands. For example, fuel cut control is performed if the amount of depression of the accelerator pedal 42 is zero or substantially zero (that is, engine load is zero or substantially zero) and the engine speed is equal to or greater than a predetermined speed higher than the speed at the time of idling.

If fuel cut control is performed, air or exhaust gas similar to air is exhausted from the internal combustion engine, and therefore gas with an extremely high air-fuel ratio (that is, extremely high lean degree) flows into the upstream side exhaust purification catalyst 20. As a result, during fuel cut control, a large amount of oxygen flows into the upstream side exhaust purification catalyst 20, and the oxygen storage amount of the upstream side exhaust purification catalyst 20 reaches the maximum storable oxygen amount.

Further, the fuel cut control is made to end if a predetermined condition for ending the fuel cut stands. As the condition for ending the fuel cut, for example, the amount of depression of the accelerator pedal 42 becoming a predetermined value or more (that is, the engine load becoming a certain extent of value) or the engine speed becoming less than a predetermined speed higher than the speed at the time of idling, etc. may be mentioned. Further, in the internal combustion engine of the present embodiment, right after the end of the fuel cut control, post-return rich control is performed which makes the air-fuel ratio of the inflowing exhaust gas a strong rich set air-fuel ratio which is richer than the rich set air-fuel ratio. Due to this, it is possible to quickly release the oxygen stored in the upstream side exhaust purification catalyst 20 during fuel cut control.

<Effect of Deviation in Downstream Side Air-Fuel Ratio Sensor>

In this regard, the richer the air-fuel ratio of the air-fuel mixture fed to the combustion chamber 5, the carbon monoxide in the exhaust gas becomes greater. If exhaust gas containing carbon monoxide reaches the upstream side exhaust purification catalyst 20, the moisture and the carbon monoxide in the exhaust gas react in the upstream side exhaust purification catalyst 20 and hydrogen and carbon dioxide are produced. Therefore, the richer the air-fuel ratio of the air-fuel mixture fed to the combustion chamber 5, the higher the concentration of hydrogen in the outflowing exhaust gas.

Further, hydrogen has a fast speed of passing through the diffusion regulating layer of the air-fuel ratio sensor. For this reason, if, due to post-reset rich control, the concentration of hydrogen in the outflowing exhaust gas becomes high, the output air-fuel ratio of the downstream side air-fuel ratio sensor 41 ends up deviating to the rich side from the actual air-fuel ratio of the exhaust gas. If the target air-fuel ratio is switched from the rich set air-fuel ratio to the lean set air-fuel ratio in a state where the concentration of hydrogen in the exhaust gas is high, even after the target air-fuel ratio is switched, the state of a high concentration of hydrogen in the exhaust gas is maintained for a predetermined time period. For this reason., the time period from after the target air-fuel ratio is switched from the rich set air-fuel ratio to the lean set air-fuel ratio until the output air-fuel ratio of the downstream side air-fuel ratio sensor 41 becomes higher than the rich judged air-fuel ratio becomes longer. As a result, while the target air-fuel ratio is set to the lean set air-fuel ratio, the amount of oxygen stored in the upstream side exhaust purification catalyst 20 is liable to increase and the exhaust emission is liable to deteriorate.

Figure 6:
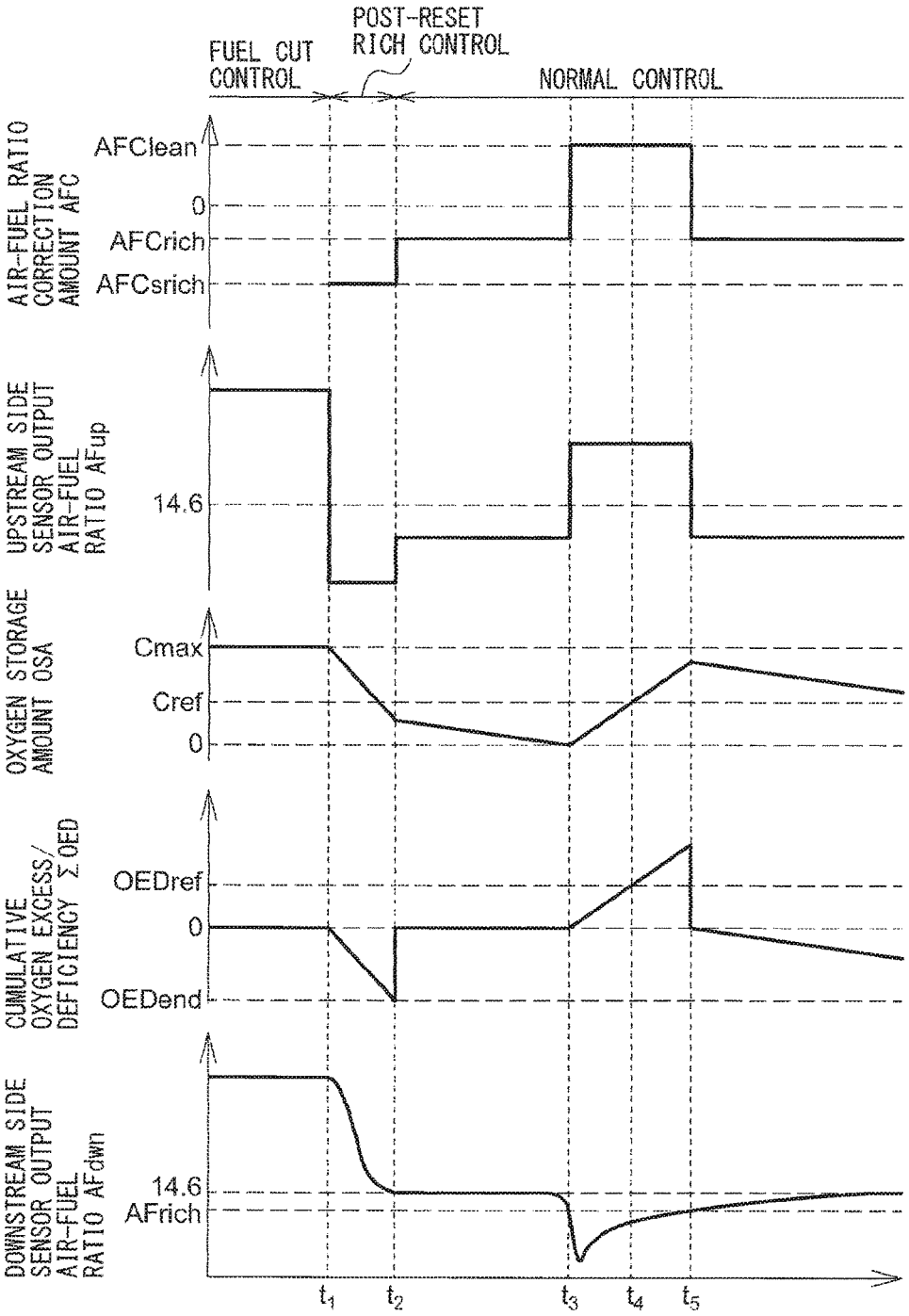
FIG. 6 is a time chart of an air-fuel ratio correction amount during fuel cut control.

Referring to FIG. 6, the above problem will be specifically explained. FIG. 6 is a time chart of the air-fuel ratio correction amount AFC, output air-fuel ratio AFup of the upstream side air-fuel ratio sensor 40, oxygen storage amount OSA of the upstream side exhaust purification catalyst 20, cumulative oxygen excess/deficiency ΣOED, and output air-fuel ratio AFdwn of the downstream side air-fuel ratio sensor 41 during fuel cut control.

In the illustrated example, fuel cut control is not performed before the time $t_1$. Due to fuel cut control, the oxygen storage amount OSA of the upstream side exhaust purification catalyst 20 becomes maximum and the inflowing exhaust gas and outflowing exhaust gas become substantially air. For this reason, before the time $t_1$, the output air-fuel ratio AFup of the upstream side air-fuel ratio sensor 40 and the output air-fuel ratio AFdwn of the downstream side air-fuel ratio sensor 41 become extremely large values.

After that, if at the time $t_1$ the fuel cut control is ended, post-reset rich control is performed to release the large amount of oxygen stored in the upstream side exhaust purification catalyst 20 during fuel cut control. In the post-reset rich control, the air-fuel ratio correction amount AFC is set to a strong rich set correction amount AFCsrich richer than the rich set correction amount AFCrich. That is, the target air-fuel ratio is set to a strong rich set air-fuel ratio richer than the rich set air-fuel ratio. Along with this, the output air-fuel ratio AFup of the upstream side air-fuel ratio sensor 40 becomes the rich air-fuel ratio (in actuality, a delay occurs from after switching the target air-fuel ratio until the air-fuel ratio of the inflowing exhaust gas changes, but in the illustrated example, for convenience, it is assumed that the change is simultaneous). Further, the output air-fuel ratio AFdwn of the downstream side air-fuel ratio sensor 41 changes to the rich side toward the stochiometric air-fuel ratio.

If the post-reset rich control is started at the time $t_1$, calculation of the cumulative oxygen excess/deficiency ΣOED is started. In post-reset rich control, the cumulative oxygen excess/deficiency ΣOED is gradually reduced. If at the time $t_2$ the cumulative oxygen excess/deficiency ΣOED reaches the control end reference value OEDend, the post-reset rich control is made to end. Further, at this time, the cumulative oxygen excess/deficiency ΣOED is reset to zero.

The absolute value of the control end reference value OEDend is set smaller than the maximum storable oxygen amount Cmax of the upstream side exhaust purification catalyst 20. For this reason, usually, after post-reset rich control, the upstream side exhaust purification catalyst 20 has oxygen remaining in it. If so, the unburned gas contained in the inflowing exhaust gas is removed by the upstream side exhaust purification catalyst 20, and the output air-fuel ratio AFdwn of the downstream side air-fuel ratio sensor 41 becomes the stoichiometric air-fuel ratio.

At the time $t_2$, normal control, that is, the basic air-fuel ratio control such as shown in FIG. 5, is resumed. At this time, the output air-fuel ratio AFdwn of the downstream side air-fuel ratio sensor 41 has not reached the rich judged air-fuel ratio AFrich, so the air-fuel ratio correction amount AFC is made the rich set correction amount AFCrich. Therefore, the target air-fuel ratio is switched from the strong rich set air-fuel ratio to the rich set air-fuel ratio.

After the time $t_2$, if, at the time $t_3$ the output air-fuel ratio AFdwn of the downstream side air-fuel ratio sensor 41 becomes the rich judged air-fuel ratio AFrich or less, the air-fuel ratio correction amount AFC is switched to the lean set correction amount AFClean. Therefore, the target air-fuel ratio is switched from the rich set air-fuel ratio to the lean set air-fuel ratio.

If the target air-fuel ratio is switched to the lean set air-fuel ratio, due to the effect of the post-reset rich control, the upstream side exhaust purification catalyst 20 has a large amount of hydrogen remaining in it. For this reason, the concentration of hydrogen in the outflowing exhaust gas becomes higher and the output air-fuel ratio of the downstream side air-fuel ratio sensor 41 deviates to the rich side. As a result, the time period from after the target air-fuel ratio is switched from the lean set air-fuel ratio until the output air-fuel ratio of the downstream side air-fuel ratio sensor 41 becomes higher than the rich judged air-fuel ratio (time $t_3$ to time $t_5$ at FIG. 6) becomes longer.

In the example of FIG. 6, at the time $t_4$, the cumulative oxygen excess/deficiency ΣOED reaches the switching reference value OEDref. However, at the time $t_4$, the output air-fuel ratio AFdwn of the downstream side air-fuel ratio sensor 41 has not reached the rich judged air-fuel ratio AFrich. Here, there is a possibility that the actual oxygen storage amount OSA of the upstream side exhaust purification catalyst 20 will be much smaller than the switching reference storage amount Cref. As this cause, for example, the output of the upstream side air-fuel ratio sensor 40 deviating to the lean side may be mentioned. For this reason, in the example of FIG. 6, at the time $t_4$, the target air-fuel ratio is not switched. After that, if, at the time $t_5$, the output air-fuel ratio AFdwn of the downstream side air-fuel ratio sensor 41 becomes higher than the rich judged air-fuel ratio AFrich, the air-fuel ratio correction amount AFC is switched to the rich set correction amount AFCrich. Therefore, the target air-fuel ratio is switched from the lean set air-fuel ratio to the rich set air-fuel ratio.

In the example of FIG. 6, the time period during which lean control is performed (time $t_3$ to time $t_5$) becomes longer. As a result, at the time $t_5$, the oxygen storage amount OSA of the upstream side exhaust purification catalyst 20 becomes a value close to the maximum storable oxygen amount Cmax. Therefore, if the output air-fuel ratio AFdwn of the downstream side air-fuel ratio sensor 41 deviates to the rich side, the oxygen storage amount of oxygen stored in the upstream side exhaust purification catalyst 20 during lean control increases and the exhaust emission is liable to deteriorate.

<Air-Fuel Ratio Control in Present Embodiment>

Therefore, in the present embodiment, a part of the basic air-fuel ratio control is changed as follows so as to suppress exhaust emission due to the output air-fuel ratio of the downstream side air-fuel ratio sensor 41 deviating to the rich side. In the present embodiment, the air-fuel ratio control device controls the target air-fuel ratio so that the average value of the target air-fuel ratio, from after the estimated value of the oxygen storage amount becomes the switching reference storage amount or more until judging that the air-fuel ratio of the outflowing exhaust gas has become the stoichiometric air-fuel ratio, becomes the stoichiometric air-fuel ratio to less than the lean set air-fuel ratio if, after setting the target air-fuel ratio to the lean set air-fuel ratio and before judging that the air-fuel ratio of the outflowing exhaust gas has become the stoichiometric air-fuel ratio, the estimated value of the oxygen storage amount of the upstream side exhaust purification catalyst 20 becomes the switching reference storage amount or more.

Figure 7:
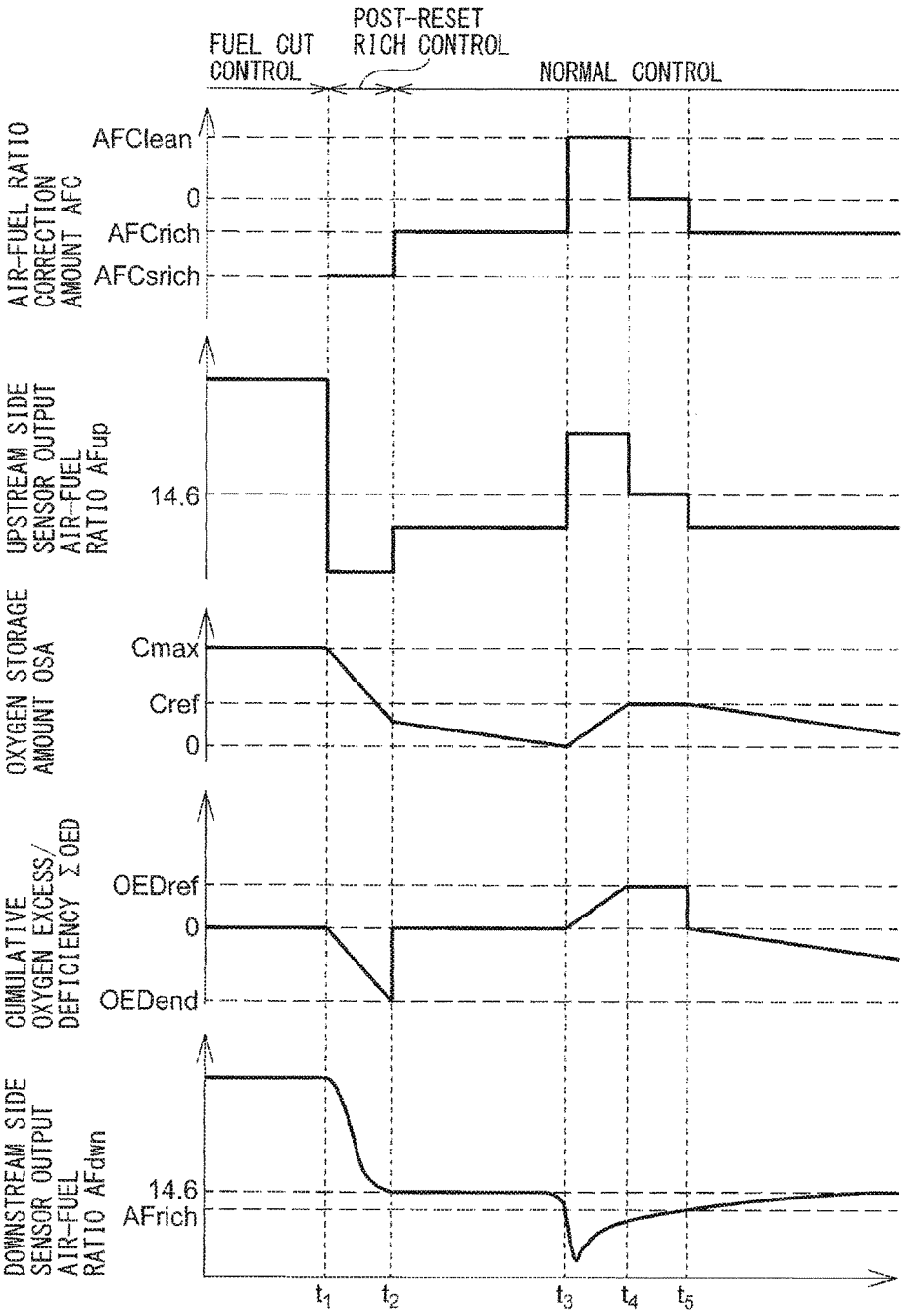
FIG. 7 is a time chart of an air-fuel ratio correction amount during fuel cut control.

Below, referring to FIG. 7, the above-mentioned control will be specifically explained. FIG. 7 is a time chart of the air-fuel ratio correction amount AFC, output air-fuel ratio AFup of the upstream side air-fuel ratio sensor 40, oxygen storage amount OSA of the upstream side exhaust purification catalyst 20, cumulative oxygen excess/deficiency ΣOED, and output air-fuel ratio AFdwn of the downstream side air-fuel ratio sensor 41 when performing fuel cut control. The time chart of FIG. 7 is basically similar to the time chart of FIG. 6, so in the following explanation, the explanation will center on parts different from the time chart of FIG. 6.

In the example of FIG. 7, in the same way as the example of FIG. 6, the cumulative oxygen excess/deficiency ΣOED reaches the switching reference value OEDref before the output air-fuel ratio AFdwn of the downstream side air-fuel ratio sensor 41 becomes higher than the rich judged air-fuel ratio AFrich. However, in the example of FIG. 7, unlike the example of FIG. 6, when at the time $t_4$ the cumulative oxygen excess/deficiency ΣOED reaches the switching reference value OEDref, the air-fuel ratio correction amount AFC is switched to zero. Therefore, the target air-fuel ratio is switched from the lean set air-fuel ratio to the stoichiometric air-fuel ratio. After that, if at the time $t_5$ the output air-fuel ratio AFdwn of the downstream side air-fuel ratio sensor 41 becomes higher than the rich judged air-fuel ratio, the air-fuel ratio correction amount AFC is switched to the rich set correction amount AFCrich. Therefore, the target air-fuel ratio is switched from the stoichiometric air-fuel ratio to the rich set air-fuel ratio.

Therefore, in the example of FIG. 7, the target air-fuel ratio is maintained at the stoichiometric air-ratio from after the cumulative oxygen excess/deficiency ΣOED reaches the switching reference value OEDref until the output air-fuel ratio AFdwn of the downstream side air-fuel ratio sensor 41 becomes higher than the rich judged air-fuel ratio. As a result, the cumulative oxygen excess/deficiency ΣOED is maintained at the switching reference value OEDref after reaching the switching reference value OEDref. For this reason, even if the output air-fuel ratio AFdwn of the downstream side air-fuel ratio sensor 41 deviates to the rich side, the oxygen storage amount OSA of oxygen stored during lean control becomes substantially the switching reference storage amount Cref. Therefore, it is possible to suppress deterioration of the exhaust emission due to the increase of the oxygen storage amount of oxygen stored in the upstream side exhaust purification catalyst 20 during lean control.

Note that, in the example of FIG. 7, from the time $t_4$ to the time $t_5$, the target air-fuel ratio is set to the stoichiometric air-fuel ratio. However, the target air-fuel ratio during this time period may be made an air-fuel ratio other than the stoichiometric air-fuel ratio if the average value of the target air-fuel ratio is the stoichiometric air-fuel ratio to less than the lean set air-fuel ratio. For example, the target air-fuel ratio during this time period may be made a weak lean set air-fuel ratio leaner than the stoichiometric air-fuel ratio and richer than the lean set air-fuel ratio. Further, the target air-fuel ratio during this time period may also temporarily be made an air-fuel ratio richer than the stoichiometric air-fuel ratio.

Further, even other than right after fuel cut control, if after setting the target air-fuel ratio to the lean set air-fuel ratio and before judging that the air-fuel ratio of the outflowing exhaust gas has become the stoichiometric air-fuel ratio, the estimated value of the oxygen storage amount of the upstream side exhaust purification catalyst 20 becomes the switching reference storage amount or more, the target air-fuel ratio is controlled so that the average value of the target air-fuel ratio, from after the estimated value of the oxygen storage amount becomes the switching reference storage amount or more until judging that the air-fuel ratio of the outflowing exhaust gas has become the stoichiometric air-fuel ratio, becomes the stoichiometric air-fuel ratio to less than the lean set air-fuel ratio.

<Control Routine of Processing for Calculating Air-Fuel Ratio Correction Amount>

Figure 8:
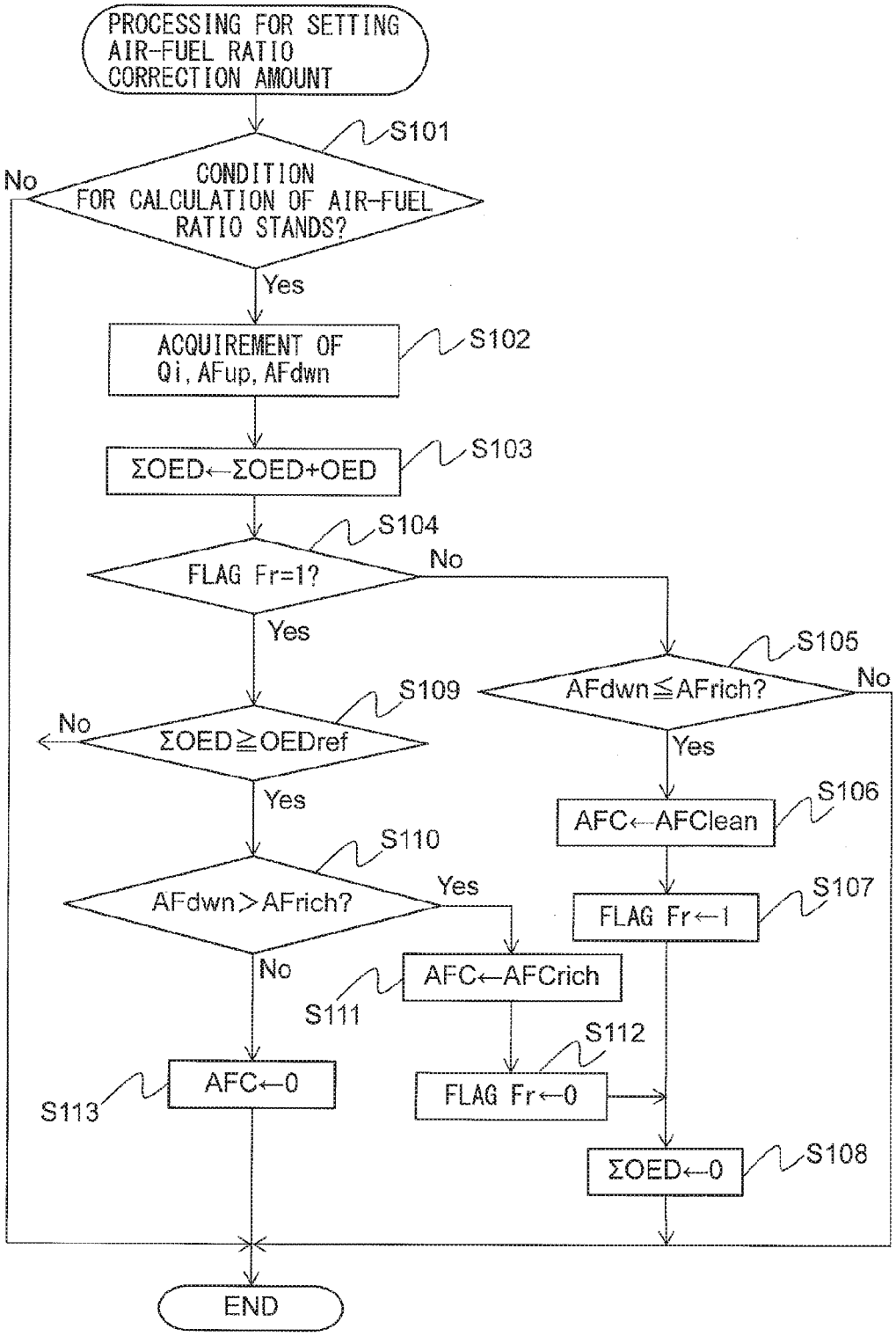
FIG. 8 is a flow chart showing a control routine of processing for calculating an air-fuel ratio correction amount.

Next, referring to the flow chart of FIG. 8, a control routine for performing the air-fuel ratio control in the present embodiment will be explained. FIG. 8 is a flow chart showing the control routine of processing for calculating an air-fuel ratio correction amount. In the illustrated control routine, the air-fuel ratio correction amount AFC is calculated, that is, the target air-fuel ratio of the inflowing exhaust gas is set. The illustrated control routine is performed by interruption every certain time interval.

First, at step S101, it is judged if the condition for calculation of the air-fuel ratio correction amount AFC stands. For example, if the air-fuel ratio sensors 40, 41 are active and the fuel cut control is not being performed, it is judged that the condition for calculation of the air-fuel ratio correction amount AFC stands. Note that, if the air-fuel ratio sensors 40, 41 are active, the temperatures of the sensor elements of the air-fuel ratio sensors 40, 41 may be predetermined values or more, for example, the impedances of the sensor elements of the air-fuel ratio sensors 40, 41 may be within predetermined values.

If at step S101 it is judged that the condition for calculation of the air-fuel ratio correction amount AFC does not stand, the present control routine is ended. On the other hand, if at step S101 it is judged that the condition for calculation of the air-fuel ratio correction amount AFC stands, the routine proceeds to step S102. At step S102, the fuel injection amount Qi, the output air-fuel ratio AFup of the upstream side air-fuel ratio sensor 40, and the output air-fuel ratio AFdwn of the downstream side air-fuel ratio sensor 41 are acquired.

Next, at step S103, a value of the cumulative oxygen excess/deficiency ΣOED of the upstream side exhaust purification catalyst 20 plus the oxygen excess/deficiency OED is made a new cumulative oxygen excess/deficiency ΣOED. The oxygen excess/deficiency OED is calculated by the above formula (1) using the fuel injection amount Qi and the output air-fuel ratio AFup of the upstream side air-fuel ratio sensor 40 which were acquired at step S102. Note that, the oxygen excess/deficiency OED may also be calculated by formula (2) using the fuel injection amount Qi acquired at step S102 and a current target air-fuel ratio TAF.

Next, at step S104, it is judged if a lean set flag Fr has been set to "1". Note that, the lean set flag Fr is a flag set to "1" if the air-fuel ratio correction amount AFC is set to the lean set correction amount AFClean and set to zero if the air-fuel ratio correction amount AFC is set to the rich set correction amount AFCrich. In other words, the lean set flag Fr is a flag set to "1" if the target air-fuel ratio is set to the lean set air-fuel ratio and set to zero if the target air-fuel ratio is set to the rich set air-fuel ratio.

If at step S104 it is judged that the lean set flag Fr is set to zero, that is, if the target air-fuel ratio is set to the rich set air-fuel ratio, the routine proceeds to step S105. At step S105, it is judged if the output air-fuel ratio AFdwn of the downstream side air-fuel ratio sensor 41 is the rich judged air-fuel ratio AFrich or less. The rich judged air-fuel ratio AFrich is a predetermined air-fuel ratio (for example, 14.55) slightly richer than the stoichiometric air-fuel ratio.

If at step S105 it is judged that the output air-fuel ratio AFdwn of the downstream side air-fuel ratio sensor 41 is larger than the rich judged air-fuel ratio AFrich, the control routine is ended. If so, the target air-fuel ratio is maintained at the rich set air-fuel ratio.

On the other hand, if at step S105 it is judged that the output air-fuel ratio AFdwn of the downstream side air-fuel ratio sensor 41 is the rich judged air-fuel ratio AFrich or less, that is, if the output air-fuel ratio AFdwn of the downstream side air-fuel ratio sensor 41 reaches the rich judged air-fuel ratio AFrich, the routine proceeds to step S106. At step S106, the air-fuel ratio correction amount AFC is set to the lean set correction amount AFClean. Therefore, the target air-fuel ratio is switched from the rich set air-fuel ratio to the lean set air-fuel ratio. Next, at step S107, the lean set flag Fr is set to "1". Next, at step S108, the cumulative oxygen excess/deficiency ΣOED is reset and made zero. After step S108, the present control routine is ended.

On the other hand, if at step S104 it is judged that the lean set flag Fr is set to "1", that is, if the target air-fuel ratio is set to the lean set air-fuel ratio, the routine proceeds to step S109. At step S109, it is judged if the cumulative oxygen excess/deficiency ΣOED of the upstream side exhaust purification catalyst 20 is a predetermined switching reference value OEDref or more.

If at step S109 it is judged that the cumulative oxygen excess/deficiency ΣOED is smaller than the switching reference value OEDref, the control routine is ended. Here, the target air-fuel ratio is maintained at the lean set air-fuel ratio. On the other hand, if at step S109 it is judged that the cumulative oxygen excess/deficiency ΣOED is the switching reference value OEDref or more, that is, if the estimated value of the oxygen storage amount of the upstream side exhaust purification catalyst 20 becomes the switching reference storage amount or more, the routine proceeds to step S110.

At step S110, it is judged if the output air-fuel ratio AFdwn of the downstream side air-fuel ratio sensor 41 is higher than the rich judged air-fuel ratio AFrich. If it is judged that the output air-fuel ratio AFdwn of the downstream side air-fuel ratio sensor 41 is higher than the rich judged air-fuel ratio AFrich, that is, if the air-fuel ratio of the outflowing exhaust gas has become the stoichiometric air-fuel ratio, the routine proceeds to step S111. At step S111, the air-fuel ratio correction amount AFC is set to the rich set correction amount AFCrich. Therefore, the target air-fuel ratio is switched from the lean set air-fuel ratio to the rich set air-fuel ratio. Next, at step S112, the lean set flag Fr is set to zero. Next, at step S108, the cumulative oxygen excess/deficiency ΣOED is reset and made zero. After step S108, the present control routine is ended.

On the other hand, if at step S110 it is judged that the output air-fuel ratio AFdwn of the downstream side air-fuel ratio sensor 41 is the rich judged air-fuel ratio AFrich or less, that is, if it is judged that the air-fuel ratio of the outflowing exhaust gas has not reached the stoichiometric air-fuel ratio, the routine proceeds to step S113. At step S113, the air-fuel ratio correction amount AFC is set to zero. Therefore, the target air-fuel ratio is switched from the lean set air-fuel ratio to the stoichiometric air-fuel ratio. After step S113, the present control routine is ended.

If, after the target air-fuel ratio is switched to the stoichiometric air-fuel ratio, the output air-fuel ratio AFdwn of the downstream side air-fuel ratio sensor 41 becomes higher than the rich judged air-fuel ratio AFrich, it is judged YES at step S110. As a result, at step S111, the air-fuel ratio correction amount AFC is set to the rich set correction amount AFCrich. Therefore, the target air-fuel ratio is switched from the stoichiometric air-fuel ratio to the rich set air-fuel ratio.

Note that, as long as the average value of the target air-fuel ratio from after the cumulative oxygen excess/deficiency ΣOED has reached the switching reference value OEDref until the target air-fuel ratio is switched to the rich set air-fuel ratio is made the stoichiometric air-fuel ratio to less than the lean set air-fuel ratio, at step S113, the air-fuel ratio correction amount AFC may be set to a value other than zero.

Further, in the internal combustion engine of the present embodiment, in a control routine separate from the control routine for the processing for calculating an air-fuel ratio correction amount, the amount of fuel fed to the combustion chamber 5 is controlled by feedback so that the output air-fuel ratio AFup of the upstream side air-fuel ratio sensor 40 becomes the target air-fuel ratio. Note that, in all of the above-mentioned control routines, the ECU 31 of the internal combustion engine is used for control.

Above, preferred embodiments of the present invention were explained, but the present invention is not limited to these embodiments and can be corrected and modified in various ways within the scope of the claims.

REFERENCE SIGNS LIST

1. engine body
5. combustion chamber
7. intake port
9. exhaust port
13. intake runner
14. surge tank
18. throttle valve
19. exhaust manifold
20. upstream side exhaust purification catalyst
24. downstream side exhaust purification catalyst
31. ECU
40. upstream side air-fuel ratio sensor
41. downstream side air-fuel ratio sensor

The invention claimed is:

1. An internal combustion engine comprising an exhaust purification catalyst arranged in an exhaust passage and able to store oxygen, a downstream side air-fuel ratio sensor arranged at a downstream side of the exhaust purification catalyst in a direction of exhaust flow and detecting an air-fuel ratio of an outflowing exhaust gas flowing out from the exhaust purification catalyst, and an electronic control unit (ECU) including control program logic configured to:

set a target air-fuel ratio of an inflowing exhaust gas flowing into the exhaust purification catalyst;

control an amount of fuel fed to a combustion chamber so that an air-fuel ratio of the inflowing exhaust gas matches the target air-fuel ratio; and switch the target air-fuel ratio to a lean set air-fuel ratio if, after setting the target air-fuel ratio to a rich set air-fuel ratio, the air-fuel ratio detected by the downstream side air-fuel ratio sensor reaches a rich judged air-fuel ratio, and switch the target air-fuel ratio to the rich set air-fuel ratio if, after setting the target air-fuel ratio to the lean set air-fuel ratio, judging that the air-fuel ratio of the outflowing exhaust gas has become a stoichiometric air-fuel ratio and an estimated value of an oxygen storage amount of the exhaust purification catalyst becomes a switching reference storage amount smaller than a maximum storable oxygen amount or becomes larger, wherein the rich set air-fuel ratio is an air-fuel ratio richer than the stoichiometric air-fuel ratio, the rich judged air-fuel ratio is an air-fuel ratio richer than the stoichiometric air-fuel ratio and leaner than the rich set air-fuel ratio, and the lean set air-fuel ratio is an air-fuel ratio leaner than the stoichiometric air-fuel ratio, the ECU is further configured to control the target air-fuel ratio so that an average value of the target air-fuel ratio, from after the estimated value of the oxygen storage amount has become the switching reference storage amount or more until judging that the air-fuel ratio of the outflowing exhaust gas has become the stoichiometric air-fuel ratio, becomes the stoichiometric air-fuel ratio to less than the lean set air-fuel ratio if, after setting the target air-fuel ratio to the lean set air-fuel ratio and before judging that the air-fuel ratio of the outflowing exhaust gas has become the stoichiometric air-fuel ratio, the estimated value of the oxygen storage amount becomes the switching reference storage amount or more.

2. The internal combustion engine according to claim 1, wherein the ECU is further configured to set the target air-fuel ratio to the stoichiometric air-fuel ratio from after the estimated value of the oxygen storage amount has become the switching reference storage amount or more until judging that the air-fuel ratio of the outflowing exhaust gas has become the stoichiometric air-fuel ratio if, after setting the target air-fuel ratio to the lean set air-fuel ratio and before judging that the air-fuel ratio of the outflowing exhaust gas has become the stoichiometric air-fuel ratio, the estimated value of the oxygen storage amount becomes the switching reference storage amount or more.

3. The internal combustion engine according to claim 1, wherein the engine further comprises an upstream side air-fuel ratio sensor arranged at an upstream side of the exhaust purification catalyst in the direction of exhaust flow and detecting the air-fuel ratio of the inflowing exhaust gas, the ECU is further configured to control by feedback an amount of fuel fed to the combustion chamber so that an air-fuel ratio detected by the upstream side air-fuel ratio sensor matches the target air-fuel ratio, and the estimated value of the oxygen storage amount is calculated based on the air-fuel ratio detected by the upstream side air-fuel ratio sensor.

4. The internal combustion engine according to claim 2, wherein the engine further comprises an upstream side air-fuel ratio sensor arranged at an upstream side of the exhaust purification catalyst in the direction of exhaust flow and detecting the air-fuel ratio of the inflowing exhaust gas, the ECU is further configured to control by feedback an amount of fuel fed to the combustion chamber so that an air-fuel ratio detected by the upstream side air-fuel ratio sensor matches the target air-fuel ratio, and the estimated value of the oxygen storage amount is calculated based on the air-fuel ratio detected by the upstream side air-fuel ratio sensor.

* * * * *